US011835062B2

(12) United States Patent
Heli et al.

(10) Patent No.: US 11,835,062 B2
(45) Date of Patent: Dec. 5, 2023

(54) COMPACT DIAGONAL FAN WITH OUTLET GUIDE VANE DEVICE

(71) Applicant: ebm-papst Mulfingen GmbH & Co. KG, Mulfingen (DE)

(72) Inventors: Thomas Heli, Langenburg (DE); Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/258,280

(22) PCT Filed: Oct. 9, 2019

(86) PCT No.: PCT/EP2019/077416
§ 371 (c)(1),
(2) Date: Jan. 6, 2021

(87) PCT Pub. No.: WO2020/099034
PCT Pub. Date: May 22, 2020

(65) Prior Publication Data

US 2021/0277910 A1 Sep. 9, 2021

(30) Foreign Application Priority Data

Nov. 16, 2018 (DE) ..... 10 2018 128 792.5

(51) Int. Cl.
*F04D 29/70* (2006.01)
*F04D 29/54* (2006.01)
(Continued)

(52) U.S. Cl.
CPC ..... *F04D 29/542* (2013.01); *F04D 17/06* (2013.01); *F04D 25/0613* (2013.01); *F04D 29/703* (2013.01)

(58) Field of Classification Search
CPC .... F04D 19/002; F04D 29/541; F04D 29/542; F04D 29/703; F04D 29/326
See application file for complete search history.

(56) References Cited

U.S. PATENT DOCUMENTS 2,015,369 A 9/1935 Shotton
4,221,546 A * 9/1980 Papst ..... F04D 29/545 415/207
(Continued)

FOREIGN PATENT DOCUMENTS

CN 101265923 A 9/2008
DE 20319749 U1 11/2004
(Continued)

OTHER PUBLICATIONS

International Search Report and Written Opinion of the International Searching Authority, issued in PCT/EP2019/077416, dated Jan. 15, 2020; ISA/EP.
(Continued)

*Primary Examiner* — Justin D Seabe
(74) *Attorney, Agent, or Firm* — Harness, Dickey & Pierce, P.L.C.

(57) ABSTRACT

A diagonal fan has an electric motor, a housing, and a diagonal impeller received in the housing. The diagonal fan is driven via the electric motor. The fan generates a diagonal flow during operation that is deflected in an axial flow direction by an inner wall of the housing. An outlet guide vane device is arranged adjacent to the diagonal impeller when viewed in the axial flow direction. The outlet guide vane device has a plurality of guide vanes that are distributed in a circumferential direction. The outlet guide vane device homogenizes an airflow generated by the diagonal impeller. The device has an air outlet with a specified outlet diameter B. The diagonal fan extends over a total axial length E. The
(Continued)

ratio of the total axial length E to the outlet diameter B is configured such that 0.3≤E/B≤0.6.

11 Claims, 4 Drawing Sheets

(51) Int. Cl.
*F04D 17/06* (2006.01)
*F04D 25/06* (2006.01)

(56) References Cited

U.S. PATENT DOCUMENTS 4,657,483 A * 4/1987 Bede ..... F04D 29/545 415/210.1
6,017,191 A * 1/2000 Harmsen ..... H05K 7/20172 415/121.2
6,503,060 B1 * 1/2003 Kamada ..... F24F 13/082 415/121.2
7,118,333 B2 * 10/2006 Takemoto ..... F04D 29/703 415/121.2
7,172,387 B2 * 2/2007 Yamamoto ..... F24F 1/38 415/121.2
7,811,055 B2 * 10/2010 Stommel ..... F01P 11/12 415/191
8,622,695 B2 * 1/2014 Decker ..... F04D 29/541 415/214.1
9,103,352 B2 * 8/2015 Sadi ..... F04D 29/703
9,816,513 B2 * 11/2017 Heli ..... F04D 25/08
10,563,669 B2 * 2/2020 Sakoda ..... F04D 29/667
10,871,172 B2 * 12/2020 Kim ..... F24F 1/56
11,242,868 B2 * 2/2022 Xu ..... F04D 25/0613
2012/0039731 A1 2/2012 Sadi et al.
2015/0147170 A1 5/2015 Heli
2017/0102007 A1 4/2017 Stauter et al.
2018/0142704 A1 * 5/2018 Sakoda ..... F04D 19/002

FOREIGN PATENT DOCUMENTS

DE 202009017511 U1 5/2011
DE 202010016820 U1 3/2012
DE 102014210373 A1 12/2015
DE 102014111767 A1 2/2016
DE 202016102277 U1 5/2016
DE 202016105863 U1 11/2016
DE 202016106538 U1 12/2016
EP 2314882 A1 4/2011

OTHER PUBLICATIONS

Search Report from parent application DE 102018128792.5 dated Jan. 16, 2020.
European Office Action dated Apr. 20, 2023 in corresponding European Application No. 19786762.5.
Rittal Rsc Gmbh & Co. Kg: "Operating Instructions K2E200-AH20-05", Jan. 9, 2018, Gefunden im Internet: URL: https://cdn.sos.sk/productdata/52/69/95e369fc/k2e200-ah20-05.pdf.
European Office Action dated Oct. 9, 2023 in corresponding European Application No. 19786762.5 (6 pages).

* cited by examiner

COMPACT DIAGONAL FAN WITH OUTLET GUIDE VANE DEVICE

CROSS-REFERENCE TO RELATED APPLICATIONS

This application is a 371 U.S. National Phase of International Application No. PCT/EP2019/077416, filed Oct. 9, 2019, which claims priority to German Patent Application No. 10 2018 128 792.5, filed Nov. 16, 2018. The entire disclosures of the above applications are incorporated herein by reference.

DESCRIPTION

The disclosure relates to a compactly designed diagonal fan with an outlet guide vane device.

Diagonal fans and their use are generally known from the prior art, for example from DE 10 2014 210 373 A1.

Diagonal fans are used in applications where high air output requirements at high counter-pressures and low installation spaces are required. For example, they are used in cooling technology or extractor hoods. Due to the large motor diameter of the motor arranged centrally on the axis in relation to the installation space of diagonal fans, the outlet area at the outlet opening is relatively small. This leads to high leakage losses in the flow due to high dynamic pressure at the outlet of the diagonal fan.

Usually, axial fans are used to achieve great throw distances. However, they require a considerable axial installation space. Diagonal fans are suitable for compact designs. In addition, they have a wider range of applications at higher counter-pressures, while also offering greater efficiency. Disadvantageous is their increased space requirement for axial outflows. The disclosure solves the problem of providing a low axial installation length for axially outflowing diagonal fans while at the same time providing good pressure increases.

This problem is solved by the combination of features according to a diagonal fan comprising: an electric motor, a housing, and a diagonal received in the housing, can be driven via the electric motor. A diagonal flow is generated during operation that is deflected in an axial flow direction by an inner wall of the housing. An outlet guide vane device is arranged adjacent to the diagonal impeller in the axial flow direction, the outlet guide vane device has a plurality of guide vanes, that are distributed in a circumferential direction. The outlet guide vane device homogenizes an airflow generated by the diagonal impeller and has an air outlet with a specified outlet diameter B, wherein the diagonal fan extends over a total axial length E, and the ratio of the total axial length E to the outlet diameter B is configured such that 0.3<E/B.6.

According to the disclosure, a diagonal fan is proposed with an electric motor, a housing and a diagonal impeller that is received inside the housing. The diagonal impeller is driven via the electric motor. The diagonal flow generated by the diagonal impeller, in operation, is deflected in an axial flow direction by an inner wall of the housing. An outlet guide vane device is arranged adjacent to the diagonal impeller in the axial flow direction. The device has a plurality of guide vanes, that are distributed in the circumferential direction. The outlet guide vane device homogenizes an airflow generated by the diagonal impeller. The diagonal fan also has an air outlet with a specified outlet diameter B at the outlet guide vane device. The size of the outlet diameter B is configured, in relation to the total axial length E of the diagonal fan, such that $0.3 \leq E/B \leq 0.6$.

The combination of the use of the outlet guide vane device with a specified outlet diameter and low axial total axial length of the diagonal fan provides an increase in pressure. It also provides an improvement in efficiency for axially outflowing diagonal fans.

The diagonal flow output by the diagonal impeller is deflected in the axial direction by the housing and homogenized by the outlet guide vane device. This particular arrangement to each other also allows for a high throw distance while maintaining a compact axial design.

In an advantageous refinement of the diagonal fan, it has an air inlet with a specified intake diameter A. A ratio of the intake diameter A to the outlet diameter B is configured such that $0.70 \leq A/B \leq 0.95$. Due to a comparatively large intake diameter, compared to the outlet diameter, the radial deflection of the flow in the region of the inner wall of the housing, in the radially outer region, is lower than in the radially inner region. This makes it possible to use an outlet guide vane device with an axially short design. The radial component of the flow must be reduced in particular in the radially outer area to achieve an axial direction or deflection.

As a favorable embodiment variant, an inlet nozzle is provided for the diagonal fan. The inlet nozzle is arranged on the intake side on the housing. The inlet nozzle then determines the intake diameter A.

In a further geometrically advantageous embodiment, the outlet guide vane device has an axial extension C and the diagonal impeller has an axial impeller width D. The ratio of axial extension C to impeller width D is configured such that $0.30 \leq C/D \leq 0.75$, in particular $0.4 \leq C/D \leq 0.5$.

In an advantageous embodiment of the diagonal fan, the outlet guide vane device is formed integrally with the housing. The number of parts and assembly steps can thus be reduced. Sealing between the components is no longer required.

In a refinement, the outlet guide vane device has a protective grating extending over an outlet portion of the diagonal fan. The axial length of the protective grating is less than 50% of the maximum axial length C of the outlet guide vane device.

In a further embodiment variant of the diagonal fan, the outlet guide vane device, the housing and the protective grating are integrally formed.

In an advantageous embodiment, the protective grating furthermore has a plurality of annular webs arranged coaxially to each other. Each web forms web surfaces extending parallel to the axial flow direction and opposite to each other. Thus, the flow thus extends parallel along the web surfaces over the entire axial length of the protective grating.

In a refinement of the diagonal fan, the annular webs, in the region of the guide vanes, are formed such that they protrude axially from an inflow edge of the respective guide vanes. The guide vanes can thus be formed partly by the protruding section of the annular webs. Thus the web surfaces formed by the annular webs in the region of the guide vanes are axially enlarged. In addition, the axially protruding sections of the annular webs can serve to reinforce the guide vanes.

The guide vanes of the outlet guide vane device may have different shapes and cross-sections. In an advantageous embodiment, the guide vanes, as seen in the axial cross-section, are arcuately curved and additionally or alternatively formed in a profile shape. For example, a wing shape, a convexly curved shape, can be specified as a profile shape. Thus, the different inflow angles of the respective diagonal impellers, in use, can be taken into account. Accordingly, a straight radial extension of the guide vanes is also possible.

In addition to the forward or backward curved embodiment, as seen in the axial cross-section, the guide vanes of the outlet guide vane device, in a further alternative embodiment, can be three-dimensionally curved. The curvature is also implemented in an axial direction.

In a favorable embodiment of the diagonal fan, the guide vanes of the outlet guide vane device merge directly into the protective grating. Thus, they directly interact with regard to airflow.

In addition to the outlet guide vane device, the diagonal impeller also comprises a hub with impeller vanes fixed to the hub or formed integrally with it. The two hubs or hub regions preferably are dimensioned such that a maximum diameter G of the hub region of the outlet guide vane device is greater than a maximum diameter F of a hub of the diagonal impeller. Thus, the hub region of the outlet guide vane device covers the hub of the diagonal impeller when viewed in an axial projection.

In a further solution of the diagonal fan, it is advantageous for an axially compact embodiment. Here, the outlet guide vane device has a motor mount for the electric motor in the hub region. The hub region of the outlet guide vane device can also be formed axially retracted. Thus, motor components and the outlet guide vane device overlap when viewed in the radial section.

In an advantageous embodiment of the diagonal fan, the diagonal impeller has a slinger ring. The slinger ring surrounds the impeller vanes distributed in the circumferential direction. The slinger ring allows for an exact adjustable outflow angle as well as a flow direction at a specified angle relative to the rotational axis of the diagonal impeller.

In a further advantageous aspect, the electric motor is an external rotor motor in the diagonal fan. This allows the diagonal impeller to surround the motor. thus minimizing the axial space requirement.

In a refinement of the diagonal fan, the inlet nozzle preferably extends in the axial direction into the slinger ring. Thus, the inlet nozzle and the slinger ring overlap partially when viewed in the radial section.

DRAWINGS

The drawings described herein are for illustrative purposes only of selected embodiments and not all possible implementations, and are not intended to limit the scope of the present disclosure.

Other advantageous refinements of the disclosure are described in the dependent claims and/or are described in more detail through the drawings in conjunction with the description of the preferred embodiment of the disclosure. The drawings show:

FIGS. 1 to 4 show an exemplary embodiment of a diagonal fan 1 according to the disclosure.

Figure 1:
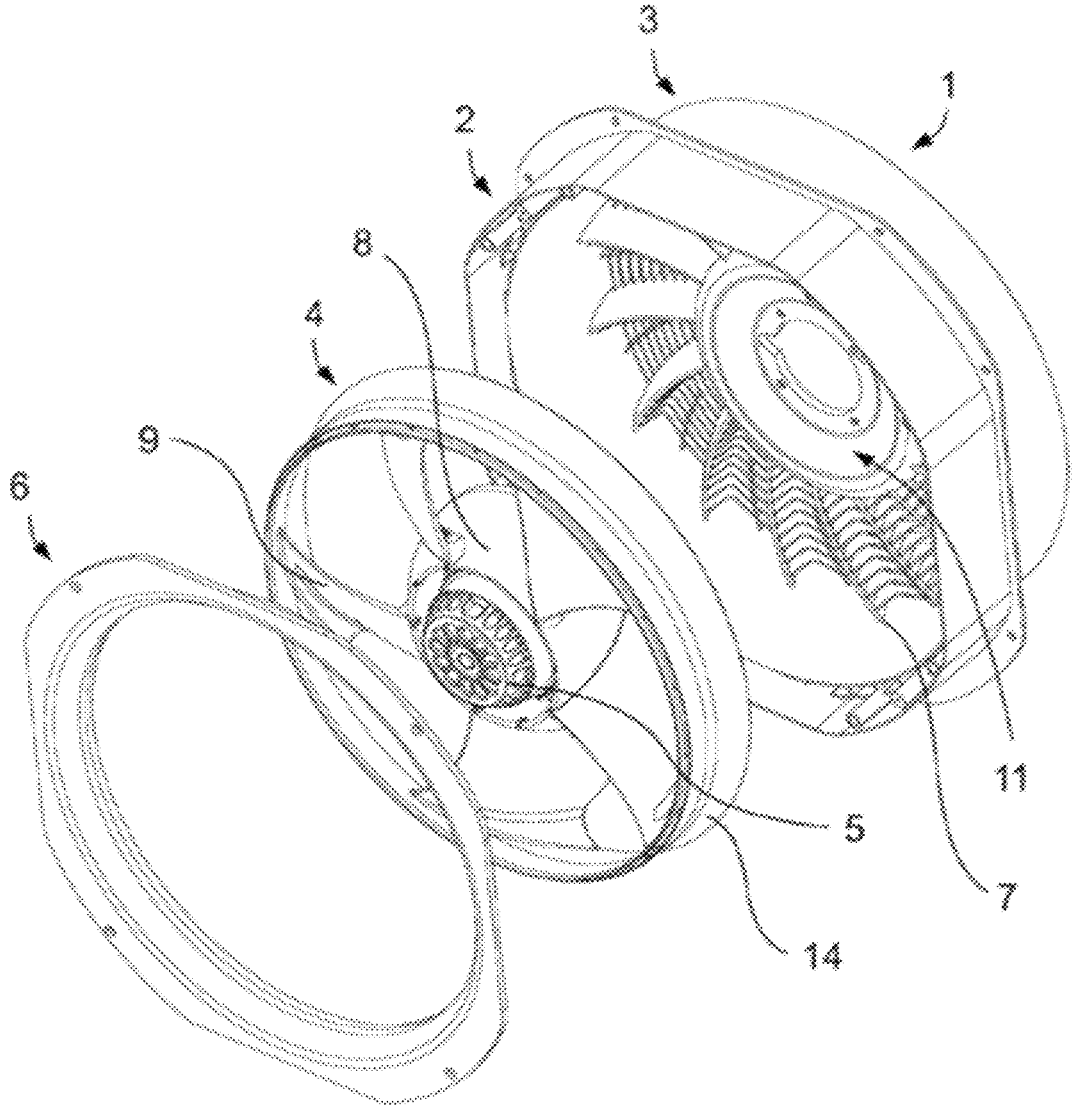
FIG. 1 is a perspective exploded view of a diagonal fan viewed in the inlet direction.
Figure 2:
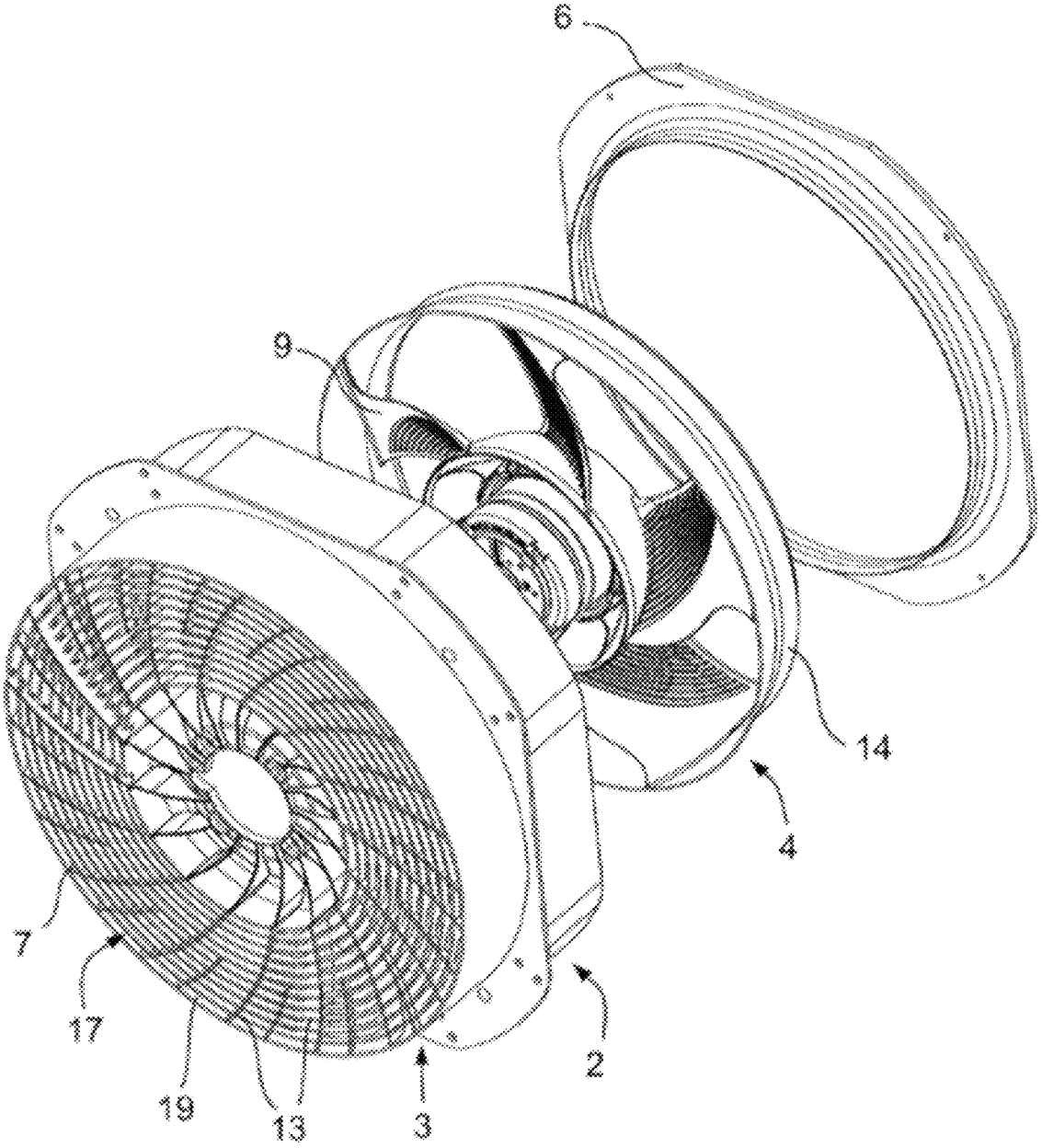
FIG. 2 is a perspective exploded view of a diagonal fan from FIG. 1 viewed in the outlet direction.

The exploded views according to FIGS. 1 and 2 illustrate a housing 2 with an integrally formed stationary outlet guide vane device 3. A diagonal impeller 4, an electric motor 5, formed as an external rotor motor, and an inlet nozzle 6 can be inserted in the housing 2.

Figure 3:
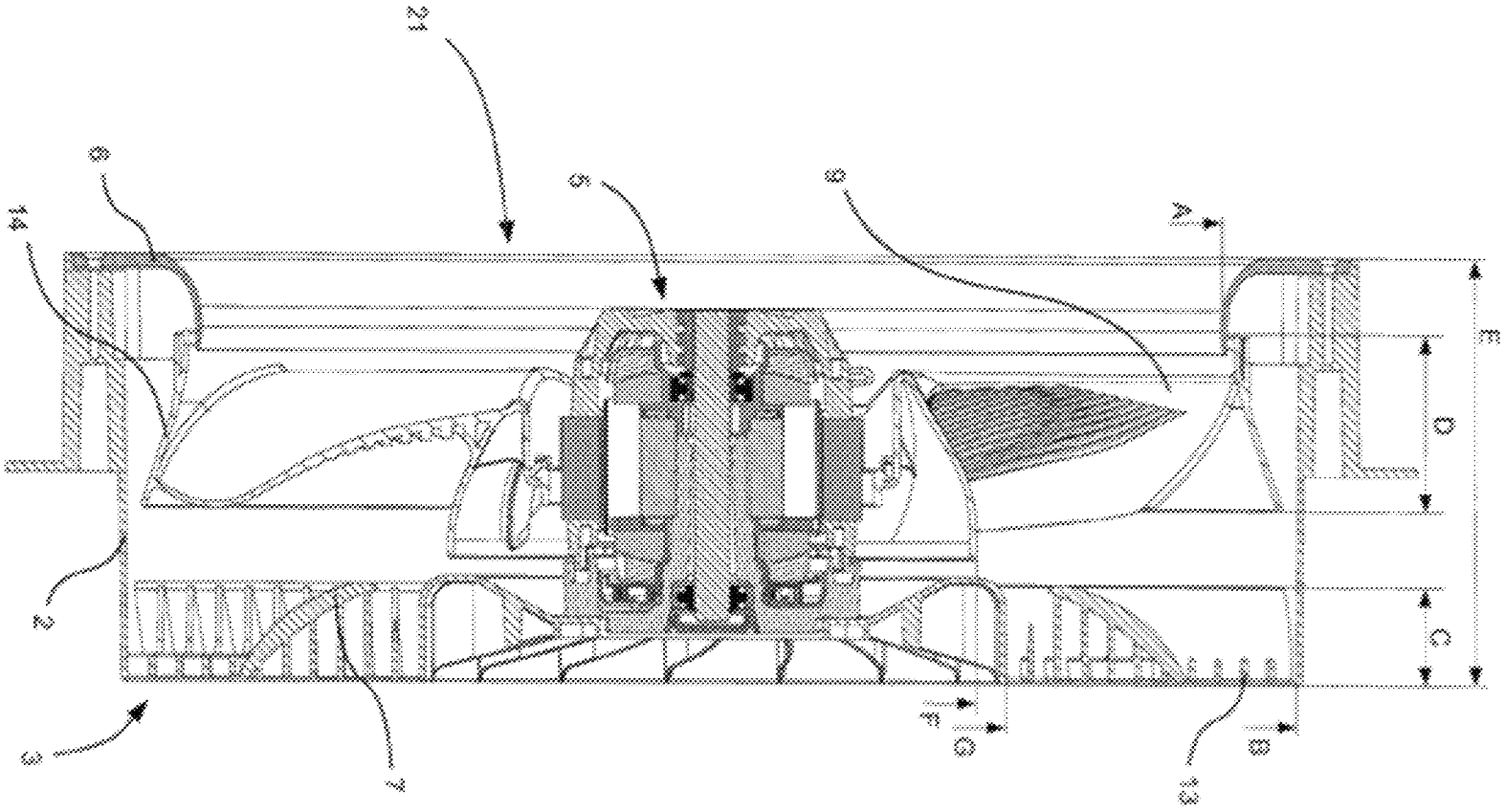
FIG. 3 is a cross section of the diagonal fan from FIG. 1.
Figure 4:
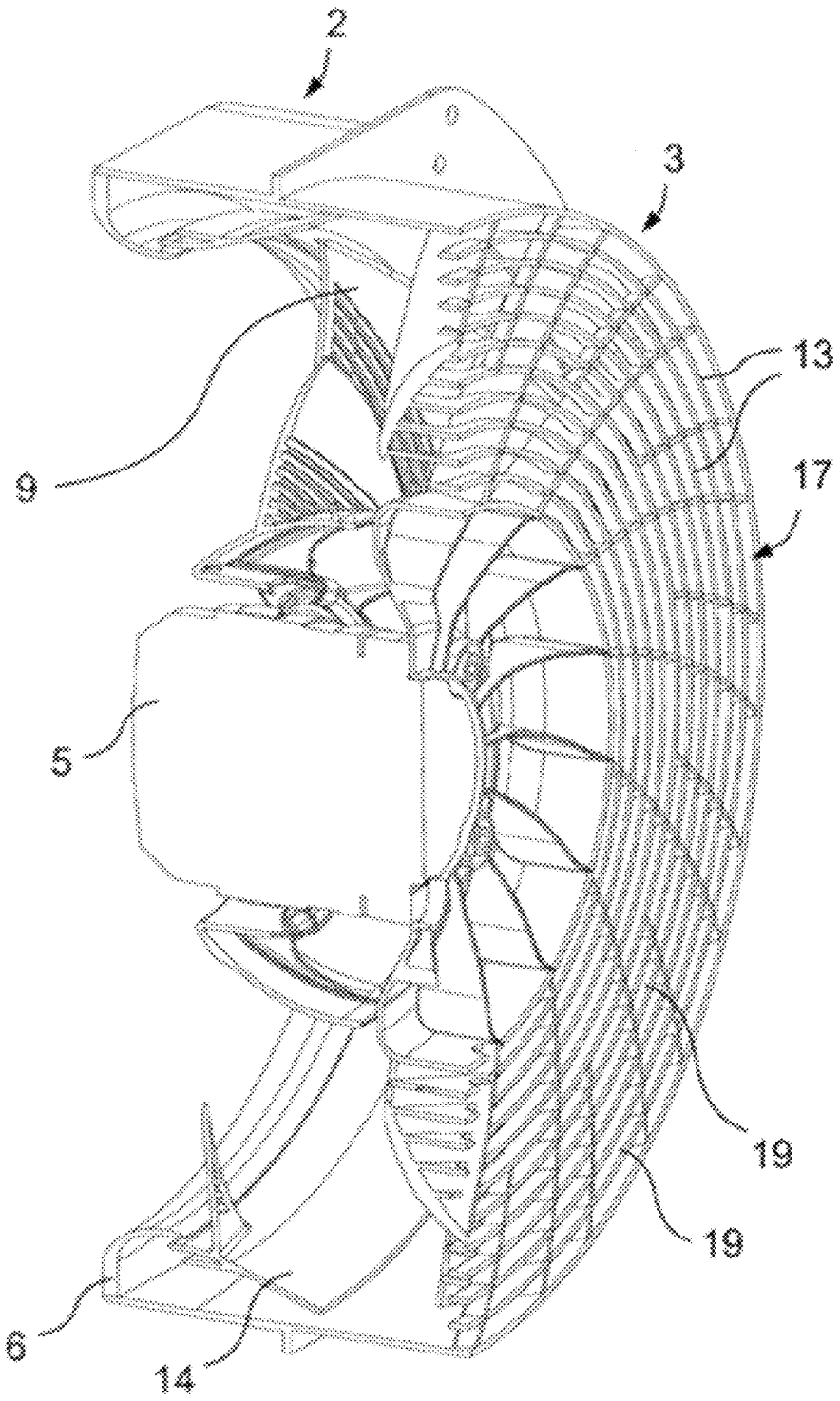
FIG. 4 is a cross section perspective view of the diagonal fan from FIG. 1.

FIGS. 3 to 4 show the diagonal fan 1 in a mounted state. The fan 1 has a total axial length E. The diagonal impeller 4 includes multiple impeller vanes 9 that extend radially outward from the axially open hub 8. The impeller vanes 9 are surrounded by a slinger ring 14. The slinger ring 14 has a cross-sectional area that expands radially outward in the axial flow direction. The slinger ring 14 is orientated toward the inner wall of the housing 2. The electric motor 5 is inserted into the axially open hub 8 of the diagonal impeller 4. The motor 5 is completely surrounded by it. In the axial direction, along the rotational axis, the electric motor 5 extends into an axially central recess 11. Thus, the latter can be positioned closer to the diagonal impeller 4. The diagonal impeller 4, driven via the electric motor 5, is arranged within the housing 2 forming a flow channel. The diagonal impeller 4 has an axial length D. The inlet nozzle 6 is arranged on the inlet side. The inlet nozzle 6, with its end portion that has the smallest cross-sectional area (diameter A), extends into the region of the diagonal impeller 4. Thus, the slinger ring 14 and the end section of the inlet nozzle 6 overlap.

In operation, the diagonal fan 1 draws in air in the axial direction via the diagonal impeller 4. The air is conveyed diagonally, at a specified outlet angle relative to the rotational axis, in the direction of the inner wall of the housing 2. In the embodiment shown here, the flow angle is determined diagonally radially outward via the slinger ring 14. The air flow is then again deflected on the inner wall of the housing 2 into an axial flow direction and is conveyed to the outlet guide vane device 3.

The air outlet of the diagonal fan 1 has a specified outlet diameter B. The ratio of total axial length E to outlet diameter B is 0.38 in the exemplary embodiment shown here. The ratio can be increased to 0.6 or reduced to 0.3. In the air inlet 21 formed by the inlet nozzle 6 (in the region of the smallest cross-sectional area of the inlet nozzle), the diagonal fan 1 has a intake diameter A which is smaller than the outlet diameter B by a factor of 0.87. The ratio can be adjusted in a range of 0.70-0.95. Thus, the required deflection of the flow in the radially outer region is low.

The outlet guide vane device 3 has a plurality of guide vanes 7. The guide are distributed in the circumferential direction. The outlet guide vane device 3 is arranged adjacently to the diagonal impeller 4 as seen in the axial flow direction. The outlet guide vane device 3 further comprises an integral protective grating 17. The protect integration has a plurality of annular webs 13 arranged coaxially to each other. Each annular web 13 forms web surfaces 19 that extend parallel to the axial flow direction and opposite to each other. The axial length of the protective grating 17 corresponds to half of the axial length C of the outlet guide vane device 3. The maximum flow cross-section of the outlet guide vane device (diameter B) on the outlet side is located in the region of the annular webs 13. The outlet guide vane device 3 homogenizes the flow by means of the guide vanes 7 and the protective grating 17. The guide vanes 7 extend through the protective grating 13 in the axial direction. Thus, they penetrate the annular webs 13 as a kind of arcuate radial webs, as is well visible in FIG. 2.

Referring to FIG. 3, the diagonal impeller extends over an axial impeller width D. The ratio of the axial extension C of the outlet guide vane device to the impeller width D has a value of 0.5 in the embodiment shown here. However, it can be set in the range of 0.30-0.75, in particular between 0.4-0.5. The ratio of the maximum diameter G of the hub region of the outlet guide vane device 3 and the maximum diameter F of the hub 8 of the diagonal impeller 4 is also shown, wherein G>F.

FIGS. 1 and 3 further show that the annular webs 13 in the region of the guide vanes 7 are formed such that they protrude axially from the inflow edge of the respective guide vanes 7 in the section 12. This ensures a reinforcement and support of the guide vanes 7. The guide vanes 7 are arcuately curved as seen in the axial cross-section as well as radially curved outward in the radial section according to FIG. 3. Thus an overall three-dimensional curvature results. In addition, the guide vanes 7 are formed in a profile shape corresponding to a wing shape, as seen in the radial section according to FIG. 3. Their respective thicknesses, as seen in the axial direction, first increase and then decrease again.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A diagonal fan comprising:

an electric motor, a housing, and a diagonal impeller received in the housing, the diagonal impeller driven via the electric motor, a diagonal flow is generated during operation that is deflected in an axial flow direction by an inner wall of the housing;

an outlet guide vane device is arranged adjacent to the diagonal impeller in the axial flow direction, the outlet guide vane device has a plurality of guide vanes, that are distributed in the circumferential direction, the outlet guide vane device has a protective grating extending over an outlet portion of the diagonal fan, the protective grating has a plurality of annular webs with a desired axial length between a leading edge and a trailing edge, arranged coaxially to each other, each web forms web surfaces extending parallel to the axial flow direction and opposite to each other, and the guide vanes extend through the protective grating penetrating the annular webs in the axial direction, the annular webs, in the region of the guide vanes, due to the guide vanes being spaced from the trailing edge of the annular webs, are axially enlarged and are formed such that the annular webs extends axially from the inflow edge of the respective guide vanes to the leading edge of the annular webs, such that the annular webs have different heights in the region of the guide vanes, to provide reinforcement and support of the guide vanes, the guide vanes are arcuately curved in the axial cross-section as well as radially curved outward in the radial section providing an overall three-dimensional curvature;

the outlet guide vane device homogenizes an airflow generated by the diagonal impeller and has an air outlet with a specified outlet diameter B, wherein the diagonal fan extends over a total axial length E, and the ratio of the total axial length E to the outlet diameter B is configured such that $0.3<E/B<0.6$.

2. The diagonal fan according to claim 1, wherein the diagonal fan has an air inlet with a specified intake diameter A, or a ratio of the intake diameter A to the outlet diameter B is configured such that $0.70\leq A/B\leq 0.95$.

3. The diagonal fan according to claim 2 further comprising an inlet nozzle, the inlet nozzle is arranged on the intake side of the housing, and the inlet nozzle determines the intake diameter A.

4. The diagonal fan according to claim 1, wherein the outlet guide vane device has an axial extension C and the diagonal impeller has an axial impeller width D, and the ratio of the axial extension C to impeller width D is configured such that $0.30\leq C/D\leq 0.75$.

5. The diagonal fan according to claim 1, wherein the protective grating has an axial length that is less than a total axial length C of the outlet guide vane device.

6. The diagonal fan according to claim 5, wherein the outlet guide vane device, the housing and the protective grating are formed integrally.

7. The diagonal fan according to claim 5, wherein the guide vanes of the outlet guide vane device merge directly into the protective grating.

8. The diagonal fan according to claim 1, wherein a maximum diameter G of a hub region of the outlet guide vane device is greater than a maximum diameter F of a hub of the diagonal impeller, such that the hub region of the outlet guide vane device covers the hub of the diagonal impeller as seen in an axial projection.

9. The diagonal fan according to claim 1, wherein the outlet guide vane device has a motor mount for the electric motor in its hub region.

10. The diagonal fan according to claim 1, wherein the diagonal impeller has a slinger ring, that surrounds the impeller vanes distributed in the circumferential direction and the slinger ring determines the outflow angle of the diagonal impeller.

11. The diagonal fan according to claim 10, wherein the inlet nozzle is arranged on the intake side of the housing and extends into the slinger ring in the axial direction.

* * * * *